United States Patent [19]

Bourne

[11] 4,264,092

[45] Apr. 28, 1981

[54] SIGNALLING MEANS FOR ROTARY LATCHES

[75] Inventor: William R. Bourne, Placentia, Calif.

[73] Assignee: The Hartwell Corporation, Placentia, Calif.

[21] Appl. No.: 11,192

[22] Filed: Feb. 12, 1979

[51] Int. Cl.[3] ..... E05C 3/04

[52] U.S. Cl. ..... 292/241; 292/252

[58] Field of Search ..... 292/240, 241, 101, 1, 292/252, 106; 70/432

[56] References Cited

U.S. PATENT DOCUMENTS

| | | | |
|---|---|---|---|
| 1,152,443 | 9/1915 | Shaw . | |
| 1,639,661 | 8/1927 | Newcomb . | |
| 2,095,271 | 10/1937 | Swanstrom | 24/221 |
| 2,143,626 | 1/1939 | Jones | 220/35 |
| 2,919,569 | 1/1960 | Davis | 70/97 |
| 2,969,667 | 1/1961 | Newcomer, Jr. et al. | 70/134 |
| 3,254,517 | 6/1966 | Wheeler | 292/240 X |
| 3,402,379 | 9/1968 | Amis, Jr. et al. | 292/252 X |
| 3,503,642 | 3/1970 | Poe | 70/432 X |
| 4,061,370 | 12/1977 | Hauber | 292/175 |

FOREIGN PATENT DOCUMENTS

| | | | |
|---|---|---|---|
| 470419 | 6/1914 | France | 292/140 |
| 27593 | 4/1924 | France | 292/140 |

*Primary Examiner*—Richard E. Moore
*Attorney, Agent, or Firm*—Lyon & Lyon

[57] ABSTRACT

A rotary latch including a hook arm joined to a drive sleeve having an end flush with a surrounding surface, the sleeve having a tool receiving socket; the socket also receiving a reciprocal signal shaft occupying a flush position when the latch is secured but automatically movable to an extended position or retracted position to signal that the latch is not secured.

10 Claims, 14 Drawing Figures

SIGNALLING MEANS FOR ROTARY LATCHES

BACKGROUND AND SUMMARY

Flush type rotationally driven latches are used extensively on aircraft; however, as the driving means remains in a flush or recessed condition, whether or not the latch is in its locked or unlocked position, observation of the exposed portions of the latch gives no indication as to the condition of the latch.

The present invention and the following copending applications are directed to rotary latches which offer solutions to this problem.

FLUSH TYPE ROTARY DRIVE FOR LATCHES
Inventor: L. Richard Poe
Ser. No. 856,504 filed Dec. 1, 1977

ROTARY LATCH AND METHOD OF OPERATION
Inventor: L. Richard Poe; William R. Bourne
Ser. No. 11,193 filed Feb. 12, 1979

More particularly, the present invention is summarized in the following objects:

First, to provide a rotary latch having a hook arm and an integral drive sleeve, the sleeve having an outer end disposed flush with a surrounding surface and a tool receiving socket, the socket having a reciprocable signal shaft occupying a position flush with the outer end of the drive sleeve when the latch is locked, one embodiment occupying an extended position and another embodiment occupying a retracted position when the latch is not secured, the position of the signal shaft being readily observable.

Second, to provide a rotary latch wherein the signal shaft is secured in its flush condition or its signal position against release due to shock or vibration.

Third, to provide a rotary latch of the type indicated in the other objects, wherein the signal shaft is secured against rotation with respect to the body of the latch, and the drive sleeve is provided with a captive ball or roller movable to lock the signal shaft in its flush position or signal position.

Other and additional objectives will become apparent upon a reading of the entire specification, drawings and claims.

BRIEF DESCRIPTION OF THE FIGURES

FIG. 7 is a fragmentary transverse sectional view also showing the restraining means.

DETAILED DESCRIPTION

Figure 1:
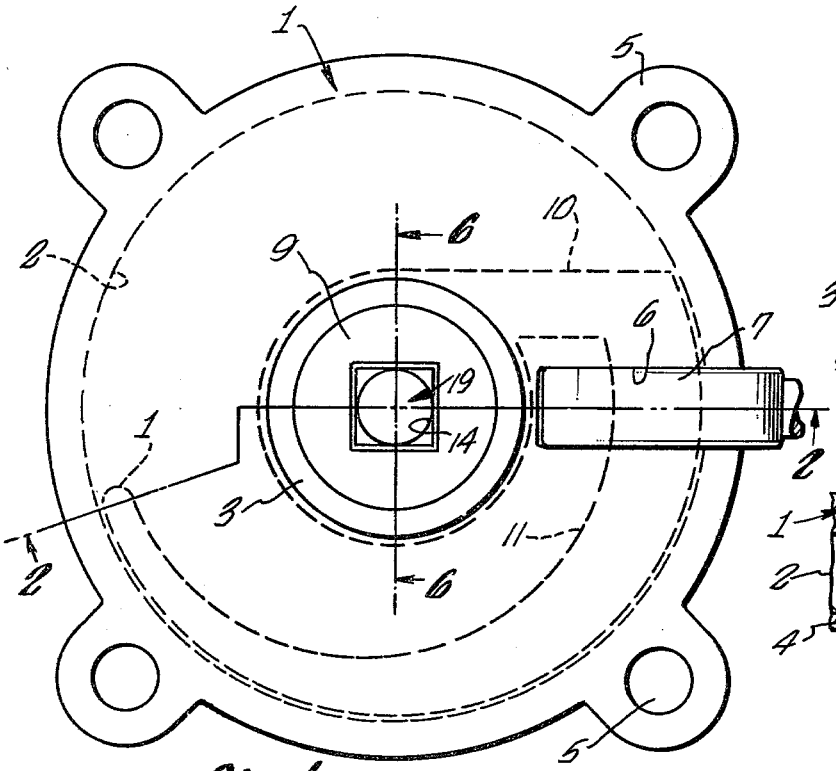
FIG. 1 is a plan view of the rotary latch shown secured to a keeper loop.

Referring to FIGS. 1 through 7, the rotary latch here illustrated includes a circular housing 1 having a flat cylindrical chamber 2 from which extends a sleeve 3. The chamber is provided with a cover plate 4. Mounting means 5 is provided to secure the rotary latch to an appropriate structure, not shown, having a surface flush with the extremity of the sleeve 3. The housing 1 and cover plate 4 have a radial keeper slot 6 which receives a keeper 7.

The chamber 2 receives a latch unit 8 having a drive sleeve 9 journalled in the sleeve 3 which is integrally joined by a connecting web 10 to an arcuate latch arm 11 conforming to the periphery of the chamber 2. The latch arm 11 tapers toward its extremity 12 which is dimensioned to receive the keeper 7 and as the latch arm is rotated, the keeper is drawn to the position indicated in FIGS. 1 and 2.

The drive sleeve is provided adjacent its extended or flush end with an internal flange 13 having a polygonal bore 14. Inwardly of the internal flange, the drive sleeve is provided with a perforation 15 which receives a key ball 16. The housing sleeve is provided with a pair of diametrically disposed main and minor detent perforations 17 and 18 which are positioned to align radially with the perforation 15.

The bore 14 of the internal flange 13 slidably receives a signal shaft 19, the inner end of which is provided with a flange 20, the outwardly facing side of which is conical. The diameter of the signal shaft is such that the key ball 16 is retained in the perforation 20. The signal shaft is provided adjacent the flange 19 with an axial as well as a rachet cam web 21 having a radially inner cam surface 22, and a radially outer cam surface 23, separated by an axially extending stop shoulder 24. The signal shaft 19 is restrained from rotation but is free to move axially. This is accomplished by a plate 25 secured to the cover plate 4 and a portion of the flange 20 which is flattened as indicated by 26.

The signal shaft 19 is provided with a socket which receives a spring 27 which engages the cover plate 4 and urges the signal shaft axially outward.

Figure 2:
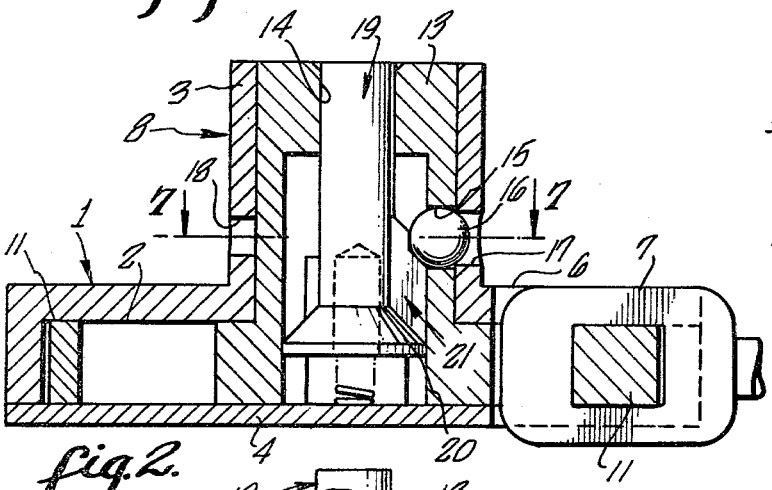
FIG. 2 is a longitudinal sectional view of the latch taken through 2—2 of FIG. 1 showing the latch in its secured position.

Operation of the rotary latch, as shown in FIGS. 1 through 7, is as follows:

When the latch is secured, its parts are disposed as shown in FIGS. 1 and 2. The base end of the latch arm 11 has drawn the keeper 7 radially inward. The exposed end of the signal flag 19 is flush with the exposed end of the drive sleeve 9 which is permanently flush with the sleeve 3 and surrounding surface. The axes of the perforations 15, 17 and 18 are coplanar. The key ball 16 bears against the shoulder 24 and cam face 23 as well as the margins of the major detent perforation 17 which is in radial alignment with the key ball. Under these conditions, the latch arm 11 is in its secured or latched engagement with the keeper 7.

Figure 4:
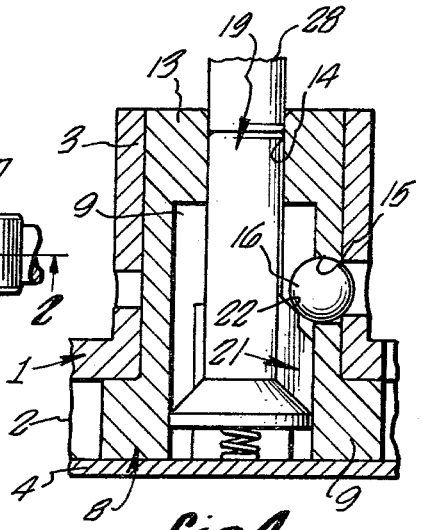
FIG. 4 is a fragmentary longitudinal sectional view, corresponding to FIG. 2, showing the latch on initial depression of the signal shaft from its flush position.
Figure 5:
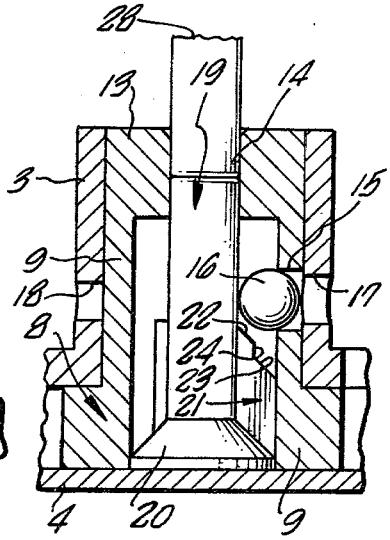
FIG. 5 is a fragmentary longitudinal sectional view, corresponding to FIG. 2, showing the signal shaft fully depressed by a tool prior to rotation to release the hook latch.
Figure 3:
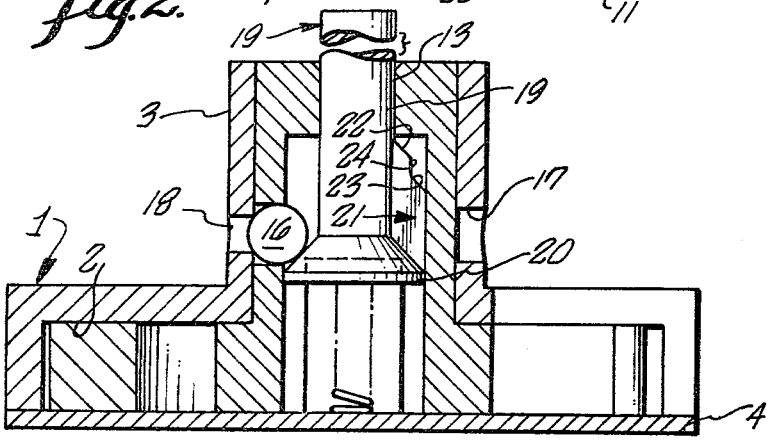
FIG. 3 is a longitudinal sectional view corresponding to FIG. 2, showing the latch in its released position.
Figure 6:
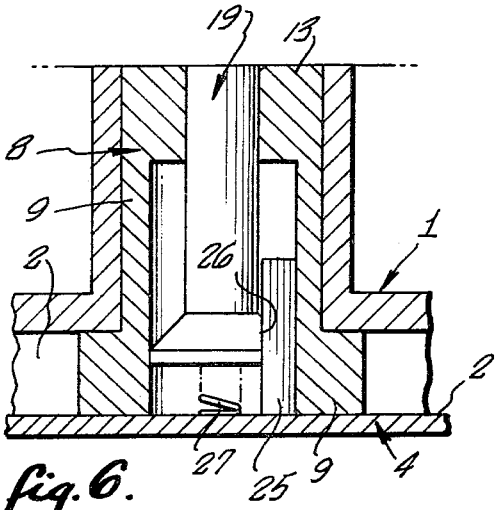
FIG. 6 is a fragmentary sectional view taken through 6—6 of FIG. 1, showing means for restraining the signal shaft against rotation.
Figure 10:
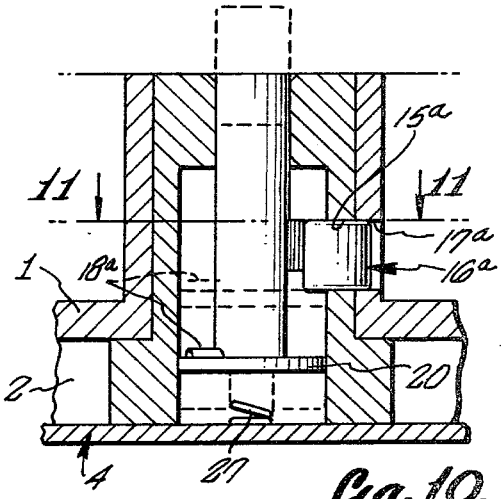
FIG. 10 is a fragmentary longitudinal sectional view, taken through 10—10 of FIG. 11, showing a modified signal shaft utilizing a cylindrical roller.
Figure 1:
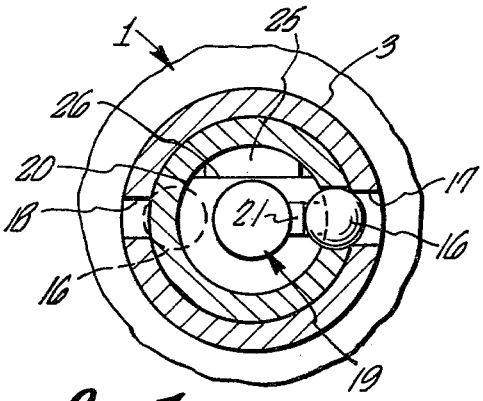
Figure 11:
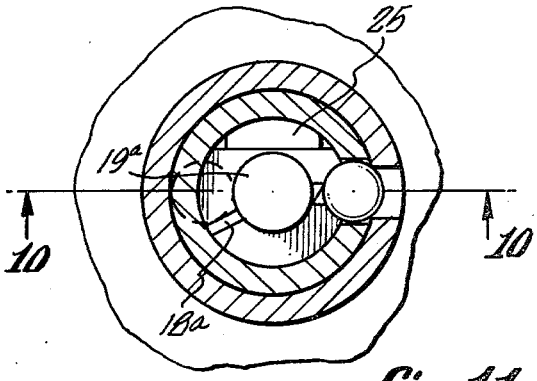
FIG. 11 is a transverse sectional view taken through 11—11 of FIG. 10.

To open or release the rotary latch a poligonal shaft 28, forming a part of a drive tool, is inserted in the poligonal bore 14, depressing the signal flag 19, as shown in FIGS. 4 and 5, causing the cam web 21 to clear the key ball 16. Upon depressing the signal shaft 19, the drive sleeve 9 may be turned counter clockwise, as viewed in FIG. 1, to withdraw the latch arm 11. Initial rotary movement of the drive sleeve 9 forces the key ball 16 from the detent perforation 17 and into contact with the signal shaft 19. Such initial movement of the drive sleeve 9 causes the key ball 16 to clear the cam web 21 so that, unless restrained by the tool shaft 20, the signal shaft 19 is movable outwardly under force of the spring 27 to a protruding or signal position, as shown in FIG. 1.

Protrusion movement of the signal shaft 19 is limited by its conical flanged end 20. The conical surface applies a radially outer force on the key ball 16 so that when the perforation 15 aligns with the detent perforation 18, as occurs when the latch is fully open, the latch is retained in such open position.

To re-secure the latch, the shaft 28 depresses the signal shaft 19, then a clockwise turning force is applied causing the latch arm 11 to engage the keeper 7, and also causing the key ball 16 to be forced from the detent perforation 17 whereupon withdrawal of the shaft 28, permits the signal shaft to return to its flush position.

Figure 8:
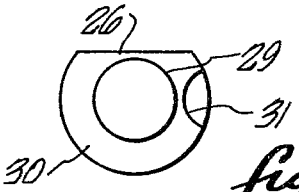
FIG. 8 is an end view of a modified signal shaft wherein the shaft occupies a depressed position as a signal that the latch is in its released position.
Figure 12:
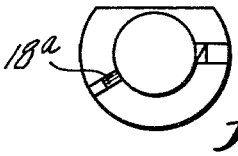
FIG. 12 is an end view of the signal shaft as modified to utilize a roller.
Figure 9:
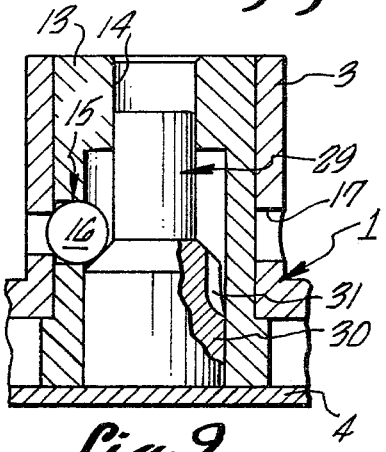
FIG. 9 is a side view thereof, with adjacent portions of the rotary latch shown fragmentarily.
Figure 13:
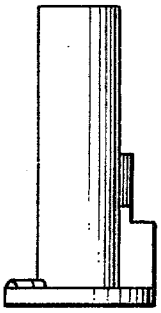
FIGS. 13 and 14 are side views of the modified signal shaft.
Figure 14:
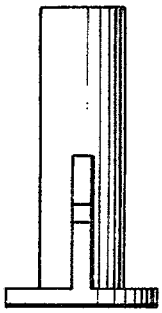

Referring to FIGS. 8 and 9 which illustrate a modified signal shaft 29 dimensioned to occupy a depressed signalling position. This is accomplished by providing a longitudinally extending end flange 30 having a locking pocket 31 which receives the key ball 16. When the key ball retainer perforation 15, locking pocket 31 and detent perforation 17 are in registry, the signal shaft 19 is flush and the rotary latch is received in its locked position.

Referring to FIGS. 10 through 14, wherein a signal shaft **19*a* is substituted for the signal shaft 19 and a key cylinder 16*a* is substituted for the key ball 16. Also essentially square or rectangular slots 15*a* and 17*a* are substituted for the circular perforations. Further the signal shaft 19*a* is provided with a flat flanged end 20*a* is provided with a radial raised detent 18*a* which performs the function of the detent perforation 18. A web 21*a* is substituted for the web 21, which provided with a peripheral cam face 22*a* above the axial shoulder 24, and a rachet shoulder 23 in place of the cam face 23 in order to accomodate the cylindrical shape of the key 16*a***.

Operation is essentially the same as the embodiment shown in FIG. 1 through 7. With regard to the detent **18*a*, its surface is rounded so that the engaging end of the key cylinder 16*a* may be forced over the detent in either direction. The detent 18*a* may be provided on the conical surfaces of the flanged ends 20 or 30 in place of the detent perforation 18**.

Having fully described my invention, it is to be understood that I am not to be limited to the details herein set forth, but that my invention is of the full scope of the appended claims.

I claim:

1. The combination with a rotary latch having a flush exposed journal sleeve, a flush exposed drive sleeve rotatable therein, and a latch arm joined to the drive sleeve for movement between a secured position and a released position with respect to a keeper, of a latch condition signalling means comprising:

a. a signal shaft axially movable in the drive sleeve from a flush position to a signalling position;

b. means restraining the signal shaft against rotation with respect to the journal sleeve;

c. a key element carried by the drive sleeve and exposed radially outwardly with respect to the journal sleeve, and exposed radially inwardly to the signal shaft;

d. a detent formed in the journal sleeve positioned for engagement with the key element when the latch arm is in its secured position;

e. a retaining element carried by the signal shaft and opposing the detent for engagement by the key element when the latch arm is in its secured position, the signal shaft being depressible to release the retaining element to permit initial rotation of the drive sleeve causing release of the key element; and f. spring means operable upon release of the key element from the retaining element and detent, to move the signal shaft to a signalling position.

2. A signalling means for rotary latches, as defined in claim 1, wherein:

a. the signal shaft when in its signalling position, protrudes with respect to the drive sleeve.

3. A signalling means for rotary latches, as defined in claim 1, wherein:

a. the signal shaft, when in its signalling position, is depressed into the drive sleeve.

4. A rotary latch comprising:

a. a keeper means;

b. a journal sleeve;

c. a drive sleeve received within said journal sleeve, said drive sleeve being adapted for rotation within said journal sleeve;

d. a latch arm arcuately movable by the drive sleeve between a secured position and a released position with respect to said keeper;

e. a signal shaft received within said drive sleeve and axially movable therein between a position indicating said latch arm and keeper secured position and said latch arm and keeper released position;

f. a key element extending through and carried by said drive sleeve;

g. a retaining means carried by said signal shaft for engaging said key element when said latch arm and keeper are in said secured position, thereby locking said latch arm and said keeper in said secured position by preventing rotation of said drive sleeve within said journal sleeve, and for disengaging said key element upon axial movement of said signal shaft within said drive sleeve in order to permit rotation of said drive sleeve and movement of said latch relative to said keeper.

5. A rotary latch, as defined in claim 4, wherein:

a. the drive sleeve includes a cylindrical portion having a radial perforation;

b. a key element is fitted in the perforation for rotation with the drive sleeve;

c. the journal sleeve is provided with a detent engaging the key element when the latch arm is in its fully secured position;

d. and the signal shaft includes a retainer element engaging the key element when the latch arm is in its fully secured position, the retainer element clearing the key element upon axially depressing the signal shaft whereupon the drive sleeve and latch arm are rotatable to move the latch arm between its fully secured and its fully released positions.

6. A rotary latch, as defined in claim 5, wherein:

a. a second detent is positioned for engagement by the key element when the latch arm is in its fully released position, the key element also being engagable with the signal shaft to position the signal flag in a signalling position.

7. A rotary latch as defined in claim 6, wherein:

a. the signal shaft is extended when in its signalling position.

8. A rotary latch as defined in claim 6, wherein:

a. the signal shaft is depressed when in its signalling position.

9. A rotary latch as defined in claim 4, wherein:

a. the key element is a sphere.

10. A rotary latch as defined in claim 4, wherein:

a. the key element is a cylinder.

* * * * *